US005976006A

United States Patent [19]

Snyder

[11] Patent Number: 5,976,006

[45] Date of Patent: Nov. 2, 1999

[54] MOTION BANK

[75] Inventor: Jeffrey Snyder, New York, N.Y.

[73] Assignee: Etna Products Co., Inc., New York, N.Y.

[21] Appl. No.: 08/878,785

[22] Filed: Jun. 19, 1997

[51] Int. Cl.[6] ..... G07D 3/04

[52] U.S. Cl. ..... 453/9; 221/186; 453/57

[58] Field of Search ..... 453/3, 5, 9, 12, 453/14, 15, 49, 57; 221/254, 186

[56] References Cited

U.S. PATENT DOCUMENTS

| | | | |
|---|---|---|---|
| 459,673 | 9/1891 | Bolton | 453/3 |
| 1,378,720 | 5/1921 | Roeling et al. | 453/9 |
| 1,889,472 | 11/1932 | Godefroid | 453/9 |
| 1,965,926 | 7/1934 | Lewis | 453/9 |
| 2,157,110 | 5/1939 | Bock et al. | 453/14 X |
| 3,703,903 | 11/1972 | Landis et al. | 453/57 |
| 5,474,496 | 12/1995 | Perkitny | 453/9 |
| 5,555,966 | 9/1996 | Tod | 453/57 X |

*Primary Examiner*—F. J. Bartuska
*Attorney, Agent, or Firm*—Levisohn, Lerner, Berger & Langsam

[57] ABSTRACT

A motorized coin bank for sorting and storing coins of varying diameters comprising a coin receiver hopper for receiving unsorted coins; a plurality of coin storage containers for storing sorted coins; a straight ramped coin path located between the coin storage containers and the coin receiver, a drum-shaped separator, located in a plane which is perpendicular to the horizontal base of the coin bank and adjacent to the coin receiver hopper, for sorting individual coins one at a time from the receiver and depositing each coin in the straight ramped coin path such that each coin rolls edgewise along the ramped coin path; a plurality of coin apertures of varying size, each being sized to permit passage of only coins having a size less than or equal to a predetermined diameter.

8 Claims, 4 Drawing Sheets

MOTION BANK

FIELD OF THE INVENTION

The present invention relates generally to the field of coin banks and more particularly to the field of motorized coin banks having coin sorters and means for receiving and storing the sorted coins.

BACKGROUND OF THE INVENTION

There exists in the market place a number of motorized coin banks having coin sorters each of which is designed to accomplish the task of receiving, sorting and storing coins with greater or lesser degree of effectiveness and using a variety of configurations to carry out the required functions.

In one motorized coin bank disclosed in U.S. Pat. No. 5,474,496, which issued to Pekitney on Dec. 12, 1995, coins are deposited in a coin receiver, and pass through a separator into a helical coin path located between the receiver and the coin storage containers, each of which is located adjacent to an aperture in the helical coin path.

The Applicant is not presently aware of any prior art reference which teaches or speaks to the totality of the invention disclosed and claimed in the present application.

SUMMARY OF THE INVENTION

The present invention is directed to a coin bank for sorting and storing of coins of varying diameters. The coin bank of the invention comprises a coin receiver hopper for receiving unsorted coins; a plurality of coin storage containers for storing sorted coins; a straight ramped coin path located between the coin storage containers and the coin receiver hopper, a separator means located adjacent to the coin receiver hopper for sorting individual coins one at a time and depositing each coin in the straight ramped coin path such that each coin rolls edgewise along the ramped path; a plurality of coin apertures of varying size, each being sized to permit passage of only coins having a size less than or equal to a predetermined diameter. The coin apertures are located along the straight ramped path such that each aperture is spaced from the other apertures and are arranged in increasing order of size such that the smallest aperture is located at an upstream portion of the path and the largest aperture is located at a downstream portion of the path. A coin storage container is located beneath each aperture to catch coins of a particular size which pass through the apertures.

The preferred and illustrated coin bank also comprises a separator means which operates in a plane which is perpendicular to the horizontal base of the coin bank for sorting coins from the receiver hopper and depositing each of them in the straight ramped coin path for sorting.

The preferred coin bank also comprises a plurality of coin storage container means which are formed as an integral part of a tray assembly which can be manually removed as a unit from beneath the coin apertures.

In the preferred embodiment the coin bank of the invention further comprises a separator means which comprises a drum shaped element which rotates in a plane which is perpendicular to the horizontal plane of the base of the coin bank, which drum shaped element is provided with a series of flat surfaces affixed about its interior circumference, and a gate means to receive a coin which has been delivered to it via the rotational motion of the drum shaped element.

In yet another aspect of the preferred embodiment of the coin bank of the invention, the coin bank is provided with an autoswitch and the necessary wiring and electrical connections to permit the automatic activation of the bank sorting mechanism upon the event of coins being deposited therein by a user.

OBJECTS OF THE INVENTION

It is therefore an object of the present invention to provide for a novel motorized coin bank.

It is a further object of the present invention to provide for a motorized coin bank which incorporates a novel separator means for separating individual coins.

It is another object of the present invention to provide for a motorized coin bank which incorporates a novel storage tray assembly for accepting and holding coin wrappers for storage of the separated coins.

It is yet another object of the invention to provide for a motorized coin bank which incorporates an autostart switching mechanism.

Lastly, it is an object of the present invention to provide for a motorized coin bank which incorporates a separator means which rotates in a plane which is perpendicular to the horizontal base of the coin bank.

These and other objects of the invention will become apparent to one skilled in the art from the following more detailed disclosure of the invention.

DESCRIPTION OF THE PREFERRED EMBODIMENT

Figure 1:
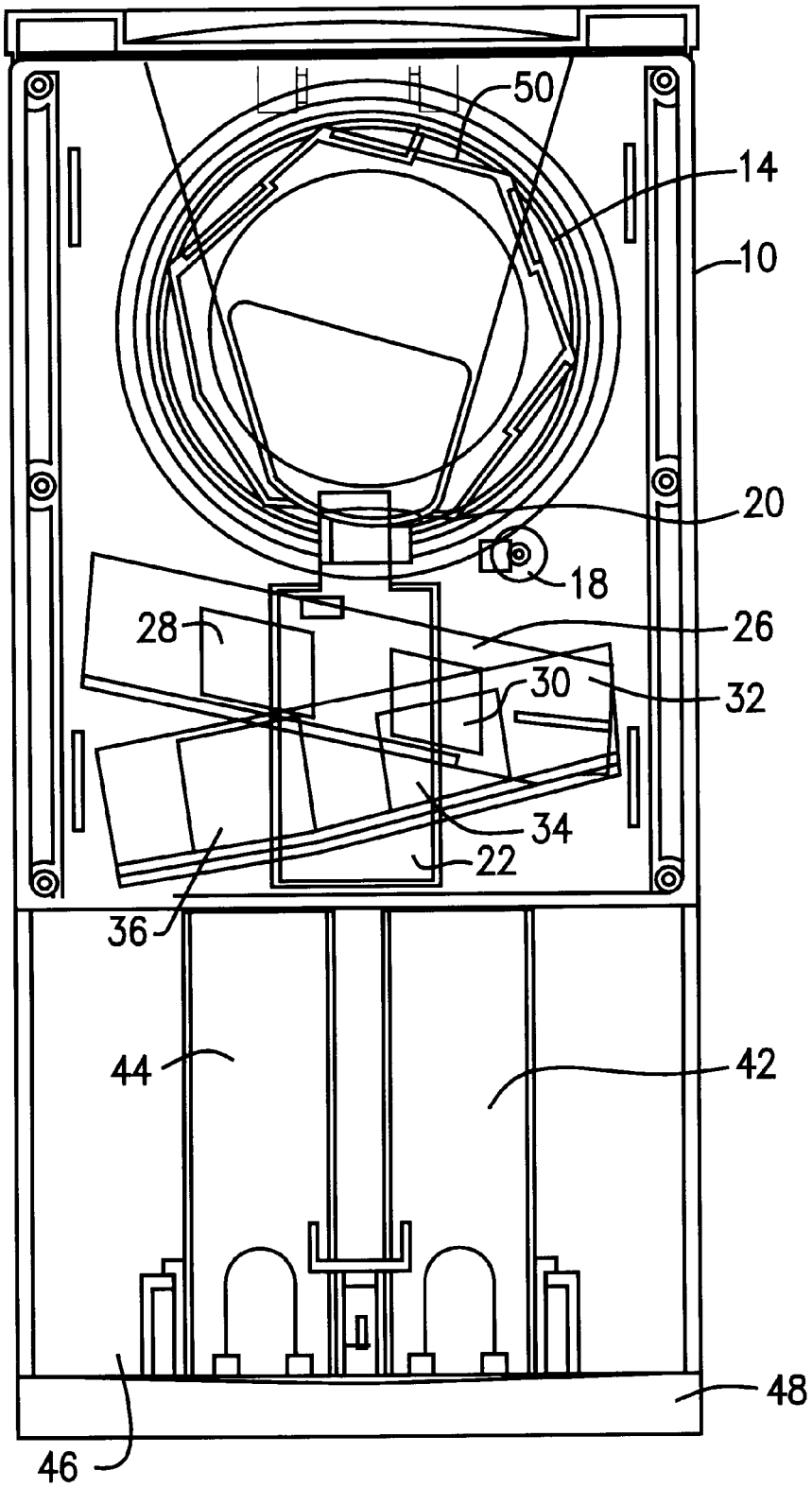
FIG. 1 is a front elevation view of the coin bank according to the invention.
Figure 2:
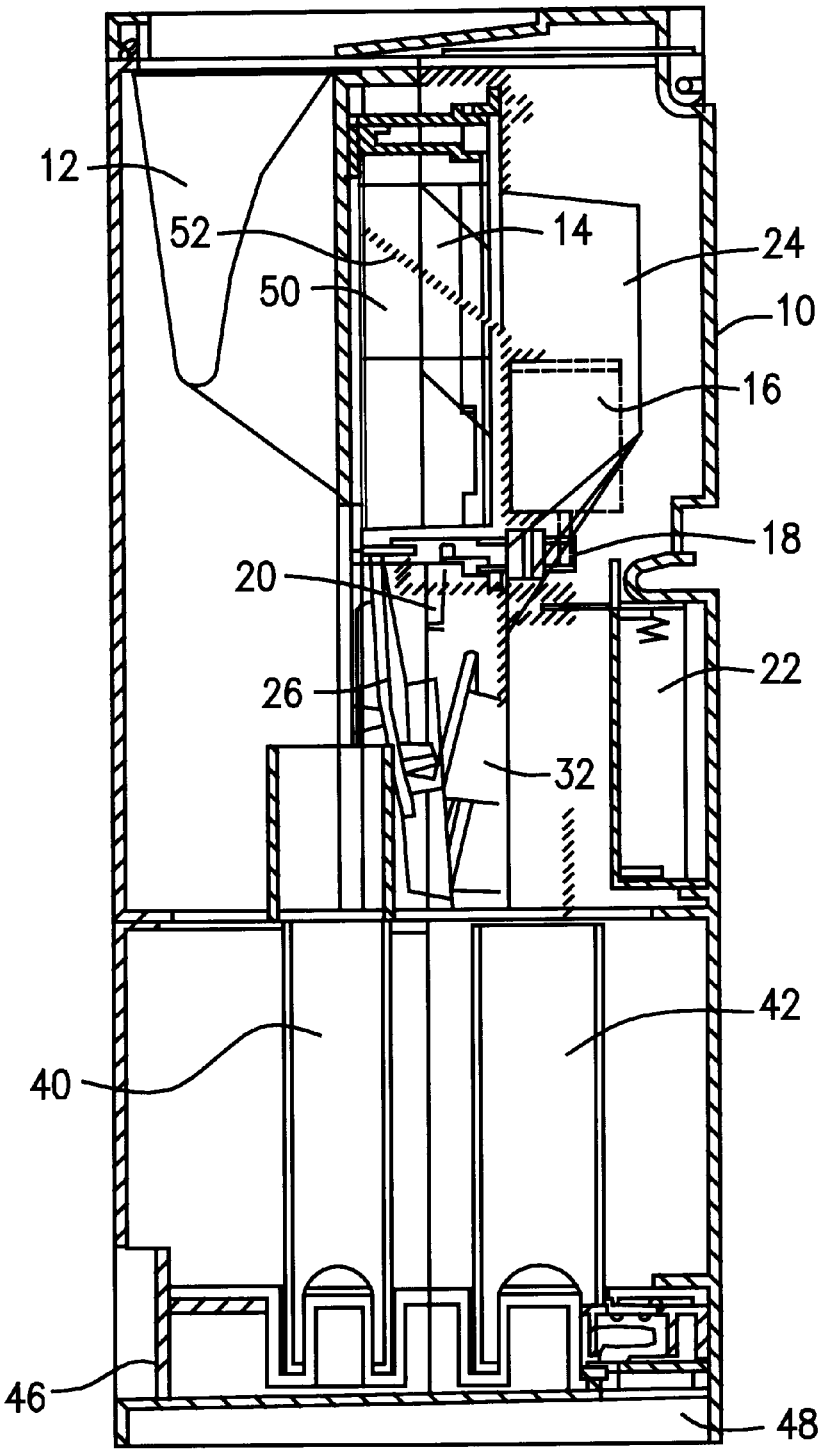
FIG. 2 is a side elevation view of the coin bank according to the invention.

With reference to FIGS. 1 and 2, a coin bank 10 according to the invention is depicted showing the receiver hopper 12 in communication with drum separator means 14, which is driven by motor 16 through drive gear 18, when autoswitch plate 20 is depressed by the weight of coins which are deposited for separation. Upon activation of autoswitch plate 20, the motor 16 is activated, powered by batteries 22, at which time drum 14 is caused to rotate in a plane perpendicular to the horizontal base of the coin bank 10, thereby operating to lift each coin and deposit it in tunnel 24. Each coin then passes through tunnel 24 via gravity and is deposited into inclined straight ramp 26, where the coin passes through one of apertures 28 or 30, or, failing to pass through such holes, moves on to inclined straight ramp 32, where the coin passes through apertures 34 or 36.

Upon passing through any of apertures 28, 30, 34 or 36 each coin then falls via gravity and is deposited in one of coin storage containers 38, 40, 42 or 44, which coin storage containers are mounted upon tray assembly 46, which is manually removable from base 48. Coin storage containers 38, 40, 42 and 44 are preferentially lined with suitably sized coin wrappers to receive the sorted coins.

Also with reference to FIGS. 1 and 2, the coin bank drum separator has a series of flat surfaces 50 affixed about the inner circumference of drum separator 14, which serve to provide an efficient surface upon which individual coins may rest while being raised by the perpendicular rotational motion of the drum. Located within the rotating drum separator means in the top most portion thereof is a gate means 52 which serves to receive each individual coin as it drops from one of the rotating inner flat surfaces 50 and to deposit the coin into tunnel 24, where it passes via gravity to inclined straight ramp 26.

Figure 3:
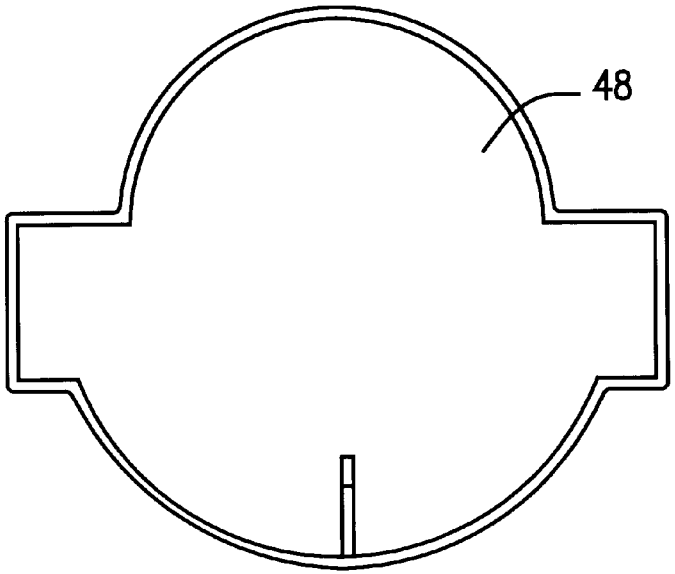
FIG. 3 is a bottom view of the coin bank according to the invention.

With reference to FIG. 3 a bottom view of the coin bank of the invention is depicted showing the outline of base 48 of the coin bank 10 and the configuration of the coin bank from this perspective.

Figure 4:
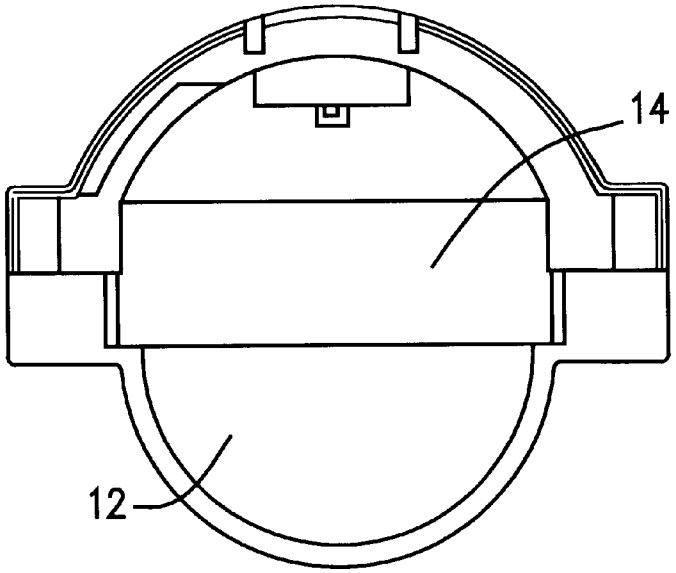
FIG. 4 is a top view of the coin bank according to the invention.

With reference to FIG. 4, a top view of the coin bank of the invention is depicted showing the top of the receiver 12 in communication with drum separator means 14 of which the top edge is shown in a perpendicular plane relative to the horizontal base of the coin bank.

Figure 5:
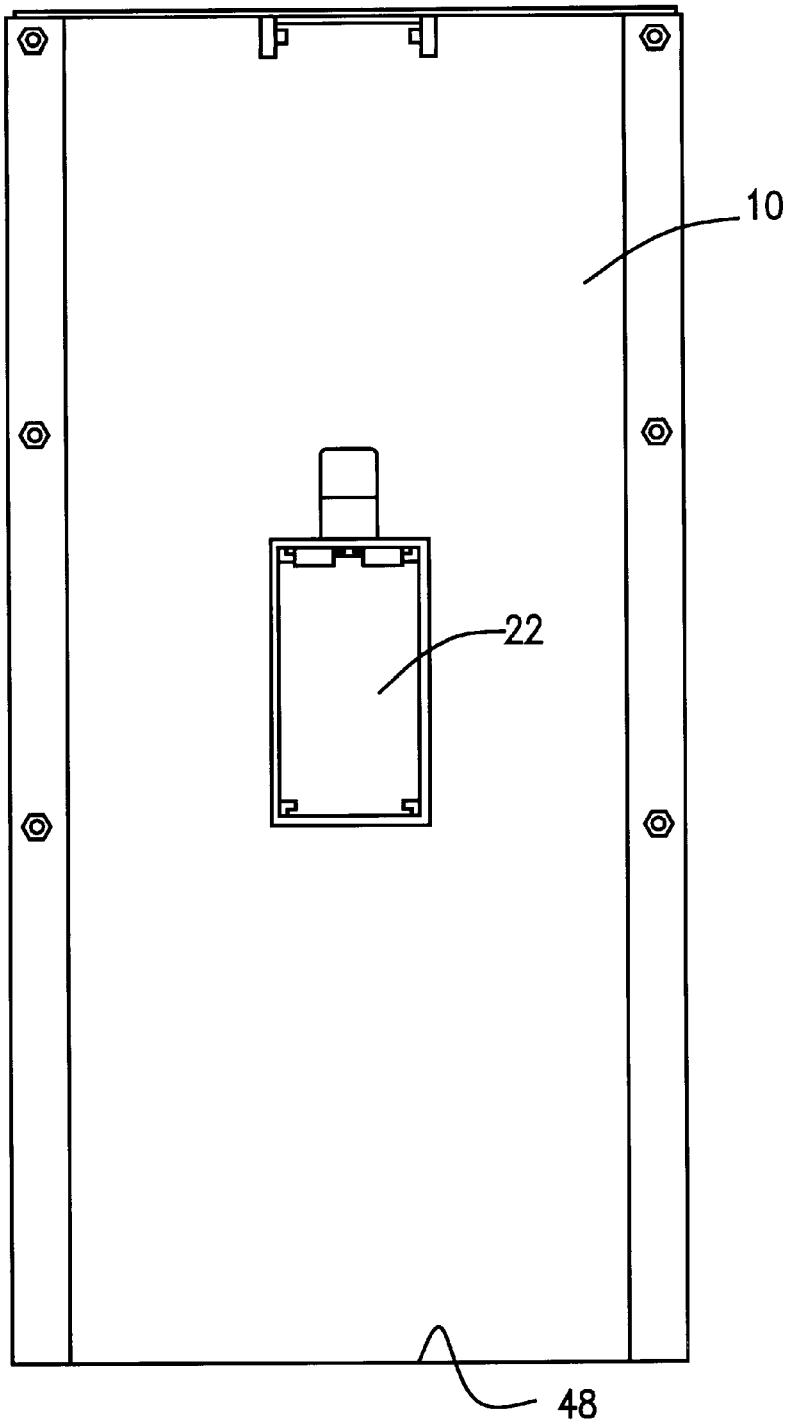
FIG. 5 is a rear view of the coin bank according to the invention.

With reference to FIG. 5, a rear view of the coin bank 10 of the invention is depicted showing the battery chamber 22 located midway up from base 48.

It will thus be seen that the objects set forth above, among those made apparent from the preceding description, are efficiently attained and, since certain changes may be made in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A motorized coin bank for sorting and storing coins of varying diameters comprising:

a coin receiver hopper for receiving unsorted coins;

a plurality of coin storage containers for storing sorted coins;

a single drum-shaped separator located in a plane which is perpendicular to the horizontal base of the coin bank and adjacent to said coin receiver hopper, and wherein coins are deposited from said coin receiver into a center of said drum-shaped separator;

a coin accepting gate located under an upper portion of said drum-shaped separator, wherein said drum-shaped separator rotates individual coins lifting said coins one at a time from said coin receiver to said upper portion, and wherein, under the force of gravity, said individual coins descend from said upper portion of said drum-shaped separator into said coin accepting gate; and a plurality of coin apertures of varying size, each being sized to permit passage of only coins having a size less than or equal to a predetermined diameter.

2. A motorized coin bank according to claim 1 wherein said drum-shaped separator further comprises a series of straight flat surfaces affixed about its interior circumference, and wherein coins may rest upon said straight flat surfaces while being raised by the rotational perpendicular motion of said drum-shaped separator to its said upper portion.

3. A motorized coin bank according to claim 1 wherein upon being sorted by passing through one of the apertures in the straight ramped coin path, each coin passes by gravity and is deposited into a coin storage container of appropriate size.

4. A motorized coin bank according to claim 1 wherein upon being sorted by passing through one of the apertures in the straight ramped coin path, each coin passes by gravity and is deposited into a coin storage container of appropriate size which is mounted in a removable tray located at the base of the coin bank.

5. A motorized coin bank according to claim 1 wherein the ramped coin path is comprised of a multiplicity of inclined ramps each having apertures of different sizes.

6. A motorized coin bank according to claim 1 which further comprises an autostart means for activating the operation of the bank, said autostart means being initiated by the weight of coins deposited in the receiver hopper.

7. A motorized coin bank according to claim 1 further comprising a discharge tunnel for directing the received coin from said coin accepting gate into said straight ramped coin path for sorting.

8. A motorized coin bank according to claim 1 further comprising a straight ramped coin path located between said coin storage containers and said coin accepting gate, wherein said straight ramped coin path is connected to said coin accepting gate so as to allow coins to pass from said coin accepting gate to said coin path under the force of gravity alone, and wherein each coin is deposited in said straight ramped coin path such that each coin rolls edgewise along the ramped coin path.

* * * * *